US005680664A

United States Patent [19]

Head

[11] Patent Number: 5,680,664

[45] Date of Patent: Oct. 28, 1997

[54] BRIDGE STRUCTURE

[75] Inventor: Peter Richard Head, Beckenham, Great Britain

[73] Assignee: Maunsell Structural Plastics Ltd., Kent, Great Britain

[21] Appl. No.: 535,235

[22] PCT Filed: May 3, 1994

[86] PCT No.: PCT/GB94/00947

§ 371 Date: Dec. 15, 1995

§ 102(e) Date: Dec. 15, 1995

[87] PCT Pub. No.: WO94/25682

PCT Pub. Date: Nov. 10, 1994

[30] Foreign Application Priority Data

May 1, 1993 [GB] United Kingdom ..... 9309062
Nov. 30, 1993 [GB] United Kingdom ..... 9324558

[51] Int. Cl.[6] ..... E01D 1/00; E01D 6/00

[52] U.S. Cl. ..... 14/4; 14/6; 14/74

[58] Field of Search ..... 14/2, 3, 4, 6, 7, 14/8, 11, 14, 15, 74, 77.1, 78, 13

[56] References Cited

U.S. PATENT DOCUMENTS 3,859,682 1/1975 Sulkiewicz ..... 14/3
4,620,400 11/1986 Richard ..... 14/3 X
4,993,094 2/1991 Muller ..... 14/6 X

*Primary Examiner*—James Lisehora
*Attorney, Agent, or Firm*—Wood, Phillips, VanSanten, Clark & Mortimer

[57] ABSTRACT

A bridge including a metal tubular space frame enclosed in a housing shell made principally from fibre reinforced plastics material which is maintenance free and protects the frame from corrosion. The upper surface of the housing shell forms a vehicular platform. The lower surface of the housing shell is of a curved aerodynamic shape and forms a load bearing access and maintenance platform. The space frame may include pre-stressing cables running alongside or inside elongate members of the space frame.

10 Claims, 8 Drawing Sheets

BRIDGE STRUCTURE

BACKGROUND OF THE INVENTION

1. Field of the Invention

The invention relates to a building structure and relates particularly, but not exclusively, to a bridge.

2. Description of the Prior Art

In recent years the superstructures of bridges for many major estuarine crossings around the world have been constructed in pre-stressed concrete. This is in spite of determined efforts by the steel bridge industry to compete in this arena, once its almost exclusive domain. In most cases, the concrete solutions were selected in preference to steel solutions on the basis of lower capital cost and lower perceived maintenance costs. Although structural steel solutions offer advantages of lightness, speed of construction and more reliable build quality, the conventional concepts and technologies being used in their design and fabrication make the solutions being offered unable to cross the critical cost divide.

At the same time, there is an increasing realisation that segmental concrete superstructures, be they pre-cast or in situ are less durable and maintenance free than previously believed. Now that an increasing number of such structures are entering into middle age, it is becoming apparent that the construction procedures adopted to protect ducted post-tensioned cables against corrosion are proving to be considerably less effective than anticipated by their designers. Furthermore, the resistance of concrete to long-term deterioration in aggressive marine and industrial atmospheres is proving to be unsatisfactory. By contrast, many steel or iron structures dating from last century which have been properly designed, constructed and maintained have exceeded their design life without the need for costly structural repairs.

One particular problem with steel bridges is the need for painting for maintenance purposes which can be expensive.

A further problem which is present for bridges of all types is aerodynamic performance. The wind can exert considerable direct forces and fatigue stresses on bridges and can cause significant oscillations. Aerodynamic performance is an important factor in determining bridge strength and design.

SUMMARY OF THE INVENTION

According to the invention there is provided a building structure comprising a space frame enclosed in a housing shell.

The space frame is thus protected from the environment by the shell.

The building structure may be of any type but suitably is a bridge or the like.

The space frame may be made of any suitable material and may be made principally from metal, preferably iron or steel. In this case, as the space frame is housed, ordinary grades of structural steel may be utilised without the need for costly painting or other protective coatings against corrosion. By comparison, in current practice only more costly grades of self weathering steel such as "corten" are used without protective coating. The space frame may include pre-stressing cables. Such cables afford significant savings in weight and cost of the space frame and increase the reliability and fatigue resistance of the space frame in particular at joints. The cables, of course, are also protected by the shell. The cables may run alongside elongate members of the space frame or may run inside elongate members of the space frame.

The housing shell is preferably aerodynamically shaped. A space frame by its nature is not aerodynamically shaped inducing high levels of turbulence. By using an aerodynamically shaped housing wind loads and fatigue stresses can be reduced. The aerodynamically shaped shell will also have an aesthetically pleasing appearance. Preferably then the housing shell is smooth over the majority of its surface. The housing shell may be convex on one side. Preferably, the housing shell is smooth over its lower surface and preferably convex over its lower surface. The shell may be symmetrical about a vertical plane.

The housing shell may be made from any suitable material and may be made at least partly from plastics material. The plastics material may be reinforced plastics material such as GRP. Preferably, that part of the shell which is made from plastics material is smoothly convex.

The space frame may be constructed in any suitable fashion and may include node elements and elongate space frame members. In a preferred embodiment, the node elements are cast. Each node element may include a plurality of sockets to receive the elongate space frame members. Preferably, the node elements and the elongate space frame members are automatically welded together.

The space frame may be of any suitable shape and may comprise a planar horizontal lattice. The space frame may alternatively or in addition comprise a convex lattice. Preferably both such lattices are provided interlinked by struts.

At least part of the housing shell may be made from a plurality of panels side by side. The panels are preferably interlinked by head-and-neck connections. The shell may be connected to the space frame by tie elements. The tie elements may be connected to the shell at the junction between two panels. The tie elements may include head-and-neck projections or complementary undercut grooves to connect with undercut grooves or head-and-neck projections on a panel. Preferably, each tie element includes at least one head-and-neck projection. Thus the projections may project from a slim sheet. Preferably each tie element includes at least one opposed head-and-neck projection.

Preferably, the underneath side of the housing shell is sufficiently strong to bear the weight of a person. This means that maintenance workers can walk through the shell thus making maintenance of the structure both easier and safer. Preferably the underneath side of the housing shell is sufficiently strong to bear the weight of a plurality of people and maintenance equipment such as scaffolding or ladders.

Two embodiments of the invention will now be described by way of example and with reference to the accompanying drawings, in which:

DESCRIPTION OF THE PREFERRED EMBODIMENTS

Figure 1:
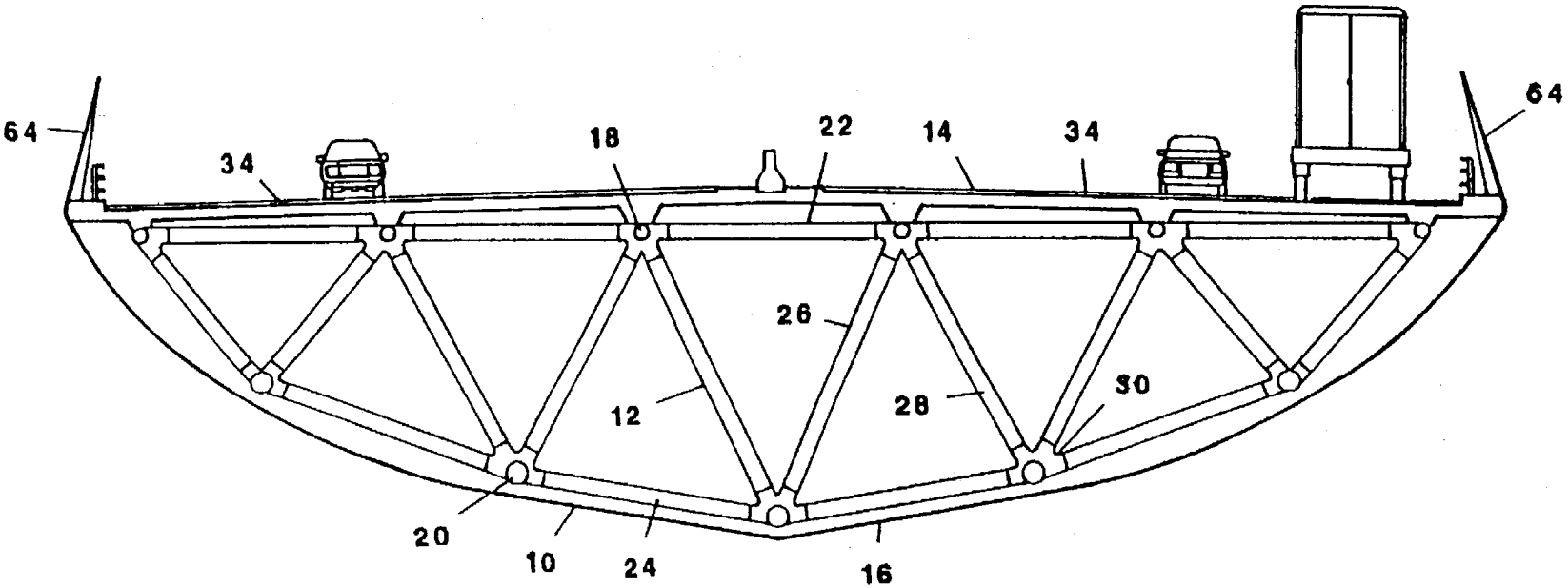
FIG. 1 is an end elevation i cross section of a first building structure according to the invention.

FIG. 1 shows a road bridge 10 which comprises a steel space frame 12 having a concrete road platform 14 thereon and enclosed underneath by a GRP section 16.

Figure 2:
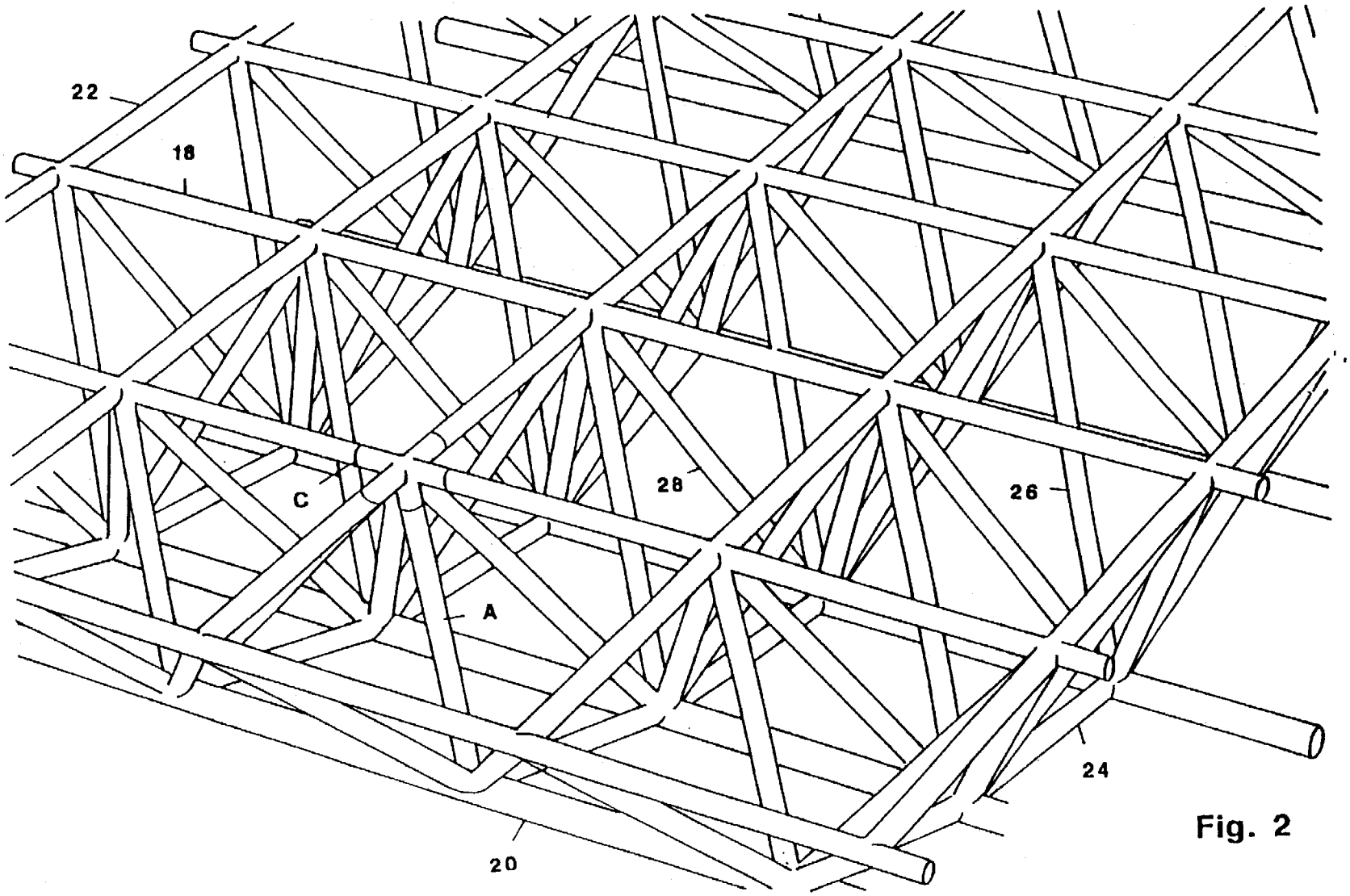
FIG. 2 is a perspective view of a space frame of the structure of FIG. 1.
Figure 3:
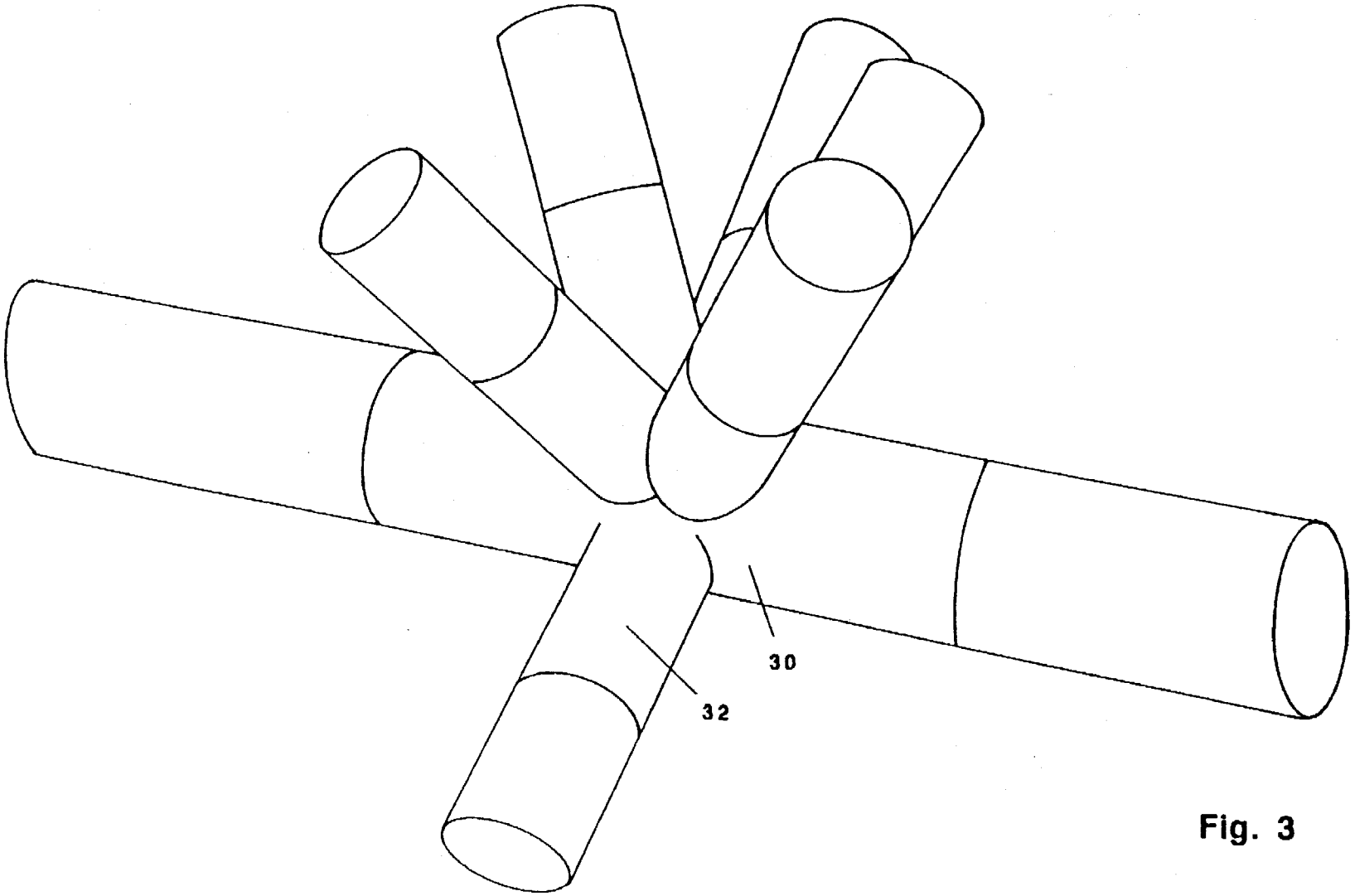
FIG. 3 is a perspective view of a node element of the space frame of FIG. 2.
Figure 4:
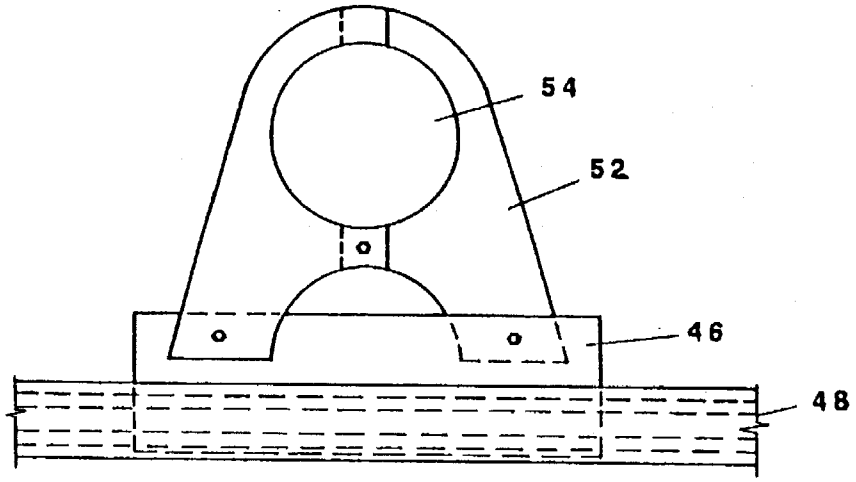
FIG. 4 is a fragmentary detail view of the first structure in end elevation.
Figure 5:
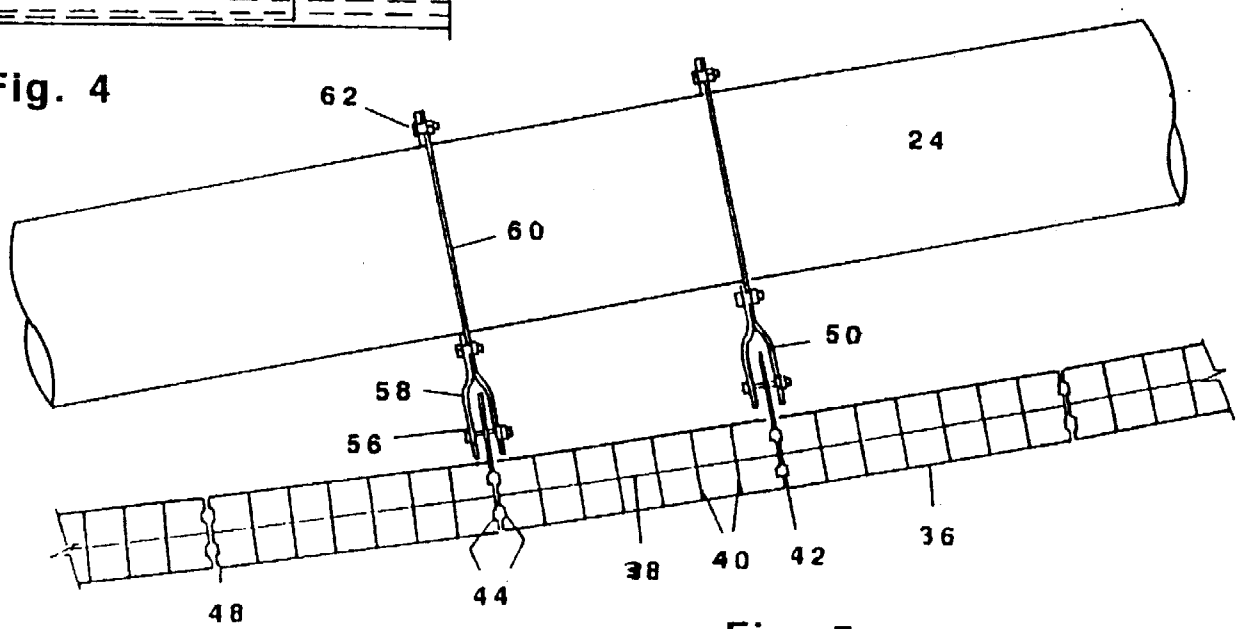
FIG. 5 is a fragmentary detail elevation of a tie element of the structure of FIG. 1.

The space frame 12 is shown in more detail in FIG. 2 and has the overall shape of a segment of a cylinder. The space frame 12 comprises six upper longitudinal beams 18 and five lower longitudinal beams 20, each lower longitudinal beam 20 lying in a plane about halfway between two adjacent upper longitudinal beams 18. The upper longitudinal beams 18 are joined by upper cross beams 22 and the lower longitudinal beams 20 are joined by lower cross beams 24. Struts 26 are provided between the lower and upper beams 18,20,22,24. The junction between each upper longitudinal beam 18 and upper cross-beam 22 is also connected by struts 26 to the four nearest intersections between a lower longitudinal beam 20 and a lower cross beam 24. Each intersection lies in a vertical plane about halfway between two adjacent upper cross beams 22.

The space frame 12 is constructed from elongate tubular members 28 which are connected at the intersections by node elements 30 which comprise a plurality of outwardly facing sockets 32. Node elements 30 can be cast from steel and can then be connected to the elongate space frame members 28 by butt welding which may be automated.

The concrete road platform 14 and underneath section 16 enclose the space frame 12 and comprise the aforesaid "housing shell". The platform 14 is in two flat sections 34 which are at a small angle to the horizontal so as to slope outwardly. Each section 34 is constructed as a reinforced concrete slab. The underneath section 16 is formed from a plurality of pultruded GRP panels 36. Each panel 36 is divided into two layers of square cells by a lateral divider 38 and a plurality of upright dividers 40. The short sides 42 of each panel 36 each define two spaced undercut grooves 44. The panels 36 are connected together short side to short side by a slim sheet 46 which includes two spaced pairs of opposed head-and-neck projections 48 to be received in the undercut grooves 44. The head-and-neck projections 48 run for the length of the grooves 44. The panels 36 are suspended from the space frame 12 by tie elements 50. Certain of the slim sheets 46 include a tab 52 having a circular aperture 54. The aperture 54 receives a short shaft 56 on a yoke 58. The yoke 58 is connected to a tie rod 60 which passes through opposed bores in an elongate space frame member 24 and receives a bolt 62 at its upper end to retain the tie element 50.

At each side of the bridge 10 is provided an upstanding porous wall 64 which slopes inwardly and may be about 3 m tall. This porous wall 64 acts as a wind shield for vehicles or people on the bridge 10.

As the space frame 12 is fully enclosed it need not be made from expensive highly corrosion resistant steel and no painting is necessary. Also, the bridge 10 presents a much more aerodynamic shape to the wind which reduces stress and wind induced oscillations on the structure. Any maintenance on the structure is easily carried out as the panels 36 will support the weight of a man so that a maintenance engineer can simply walk around inside the bridge 10 to inspect and carry out any necessary work on the space frame 12. The engineer, like the space frame is sheltered from the elements and he cannot fall from the bridge.

Figure 6:
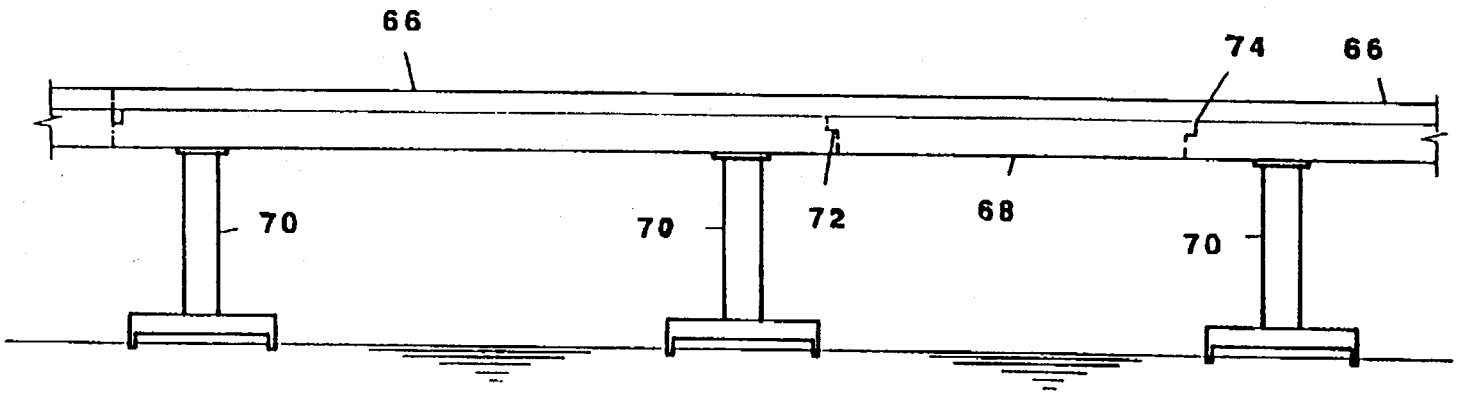
FIG. 6 is a side elevation of the first structure.

The bridge 10 may be constructed in a single span or in a plurality of spans as shown in FIG. 6. In this arrangement the bridge 10 comprises cantilever spans 66 and drop-in spans 68. The spans 66,68 are supported on a plurality of equi-spaced pillars 70. Each two adjacent pillars 70 support opposite ends of a cantilever span 66 and the drop-in span 68 is dropped down between the ends of two cantilever spans 66. The end of each cantilever span 66 includes an upwardly facing step 72 and there is an opposite, downwardly facing 74 step on the drop-in span 68 so that the drop-in span 68 can be simply lowered into position, for example, from a barge.

It is estimated that the weight saving of the invention over equivalent concrete structures is of the order of 40%–50%.

Figure 7:
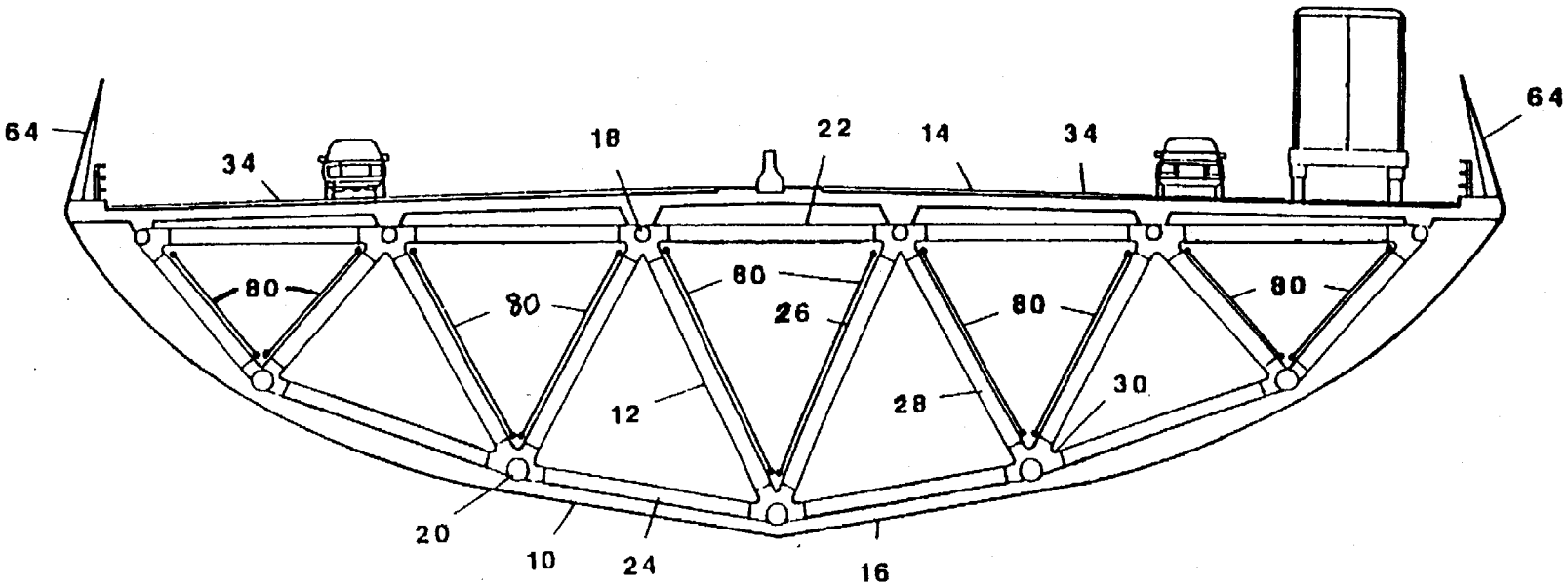
FIG. 7 is an end elevation in cross-section of a second building structure according to the invention.
Figure 8:
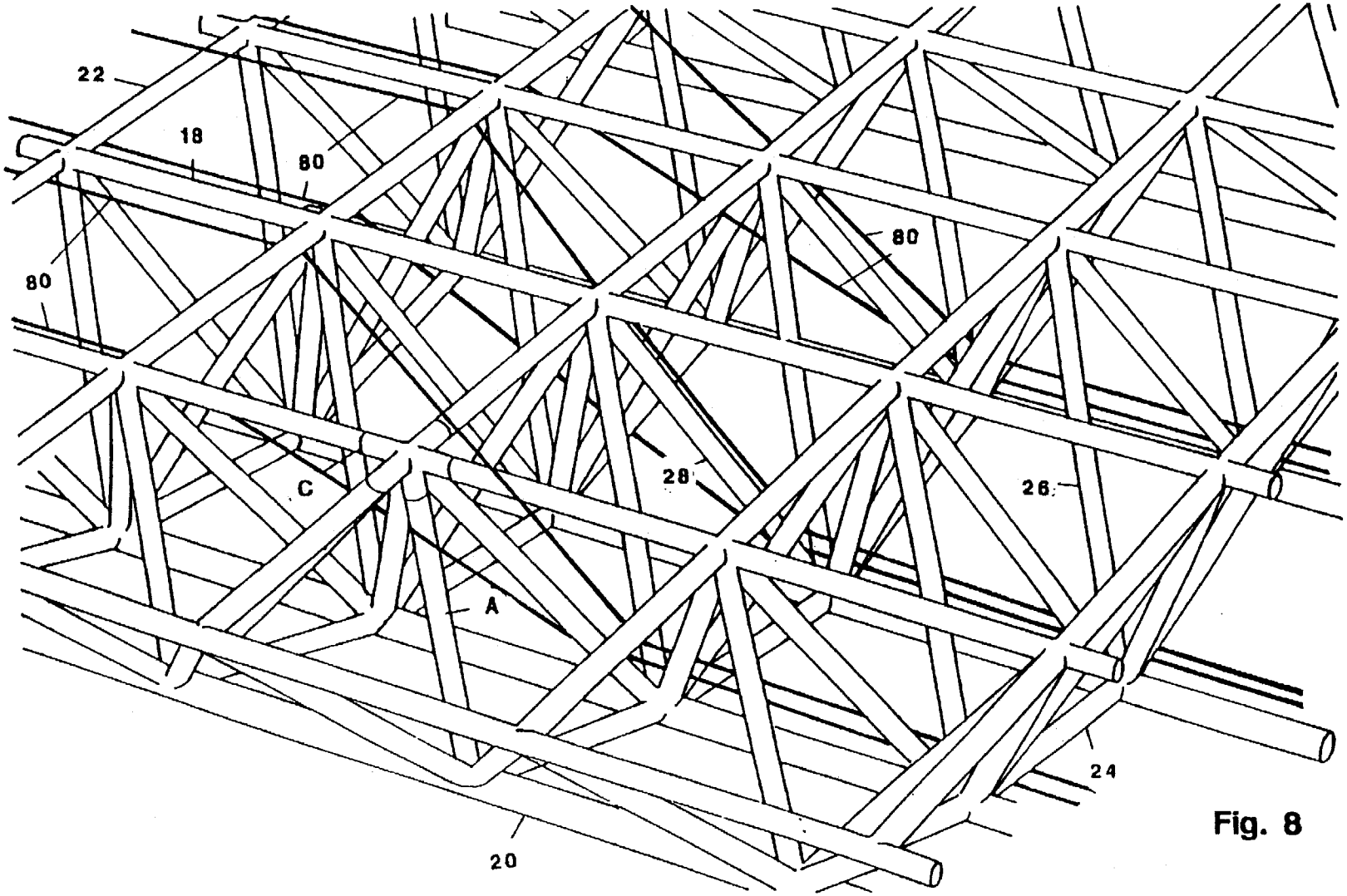
FIG. 8 is a perspective view of a space frame of the structure of FIG. 7.
Figure 9:
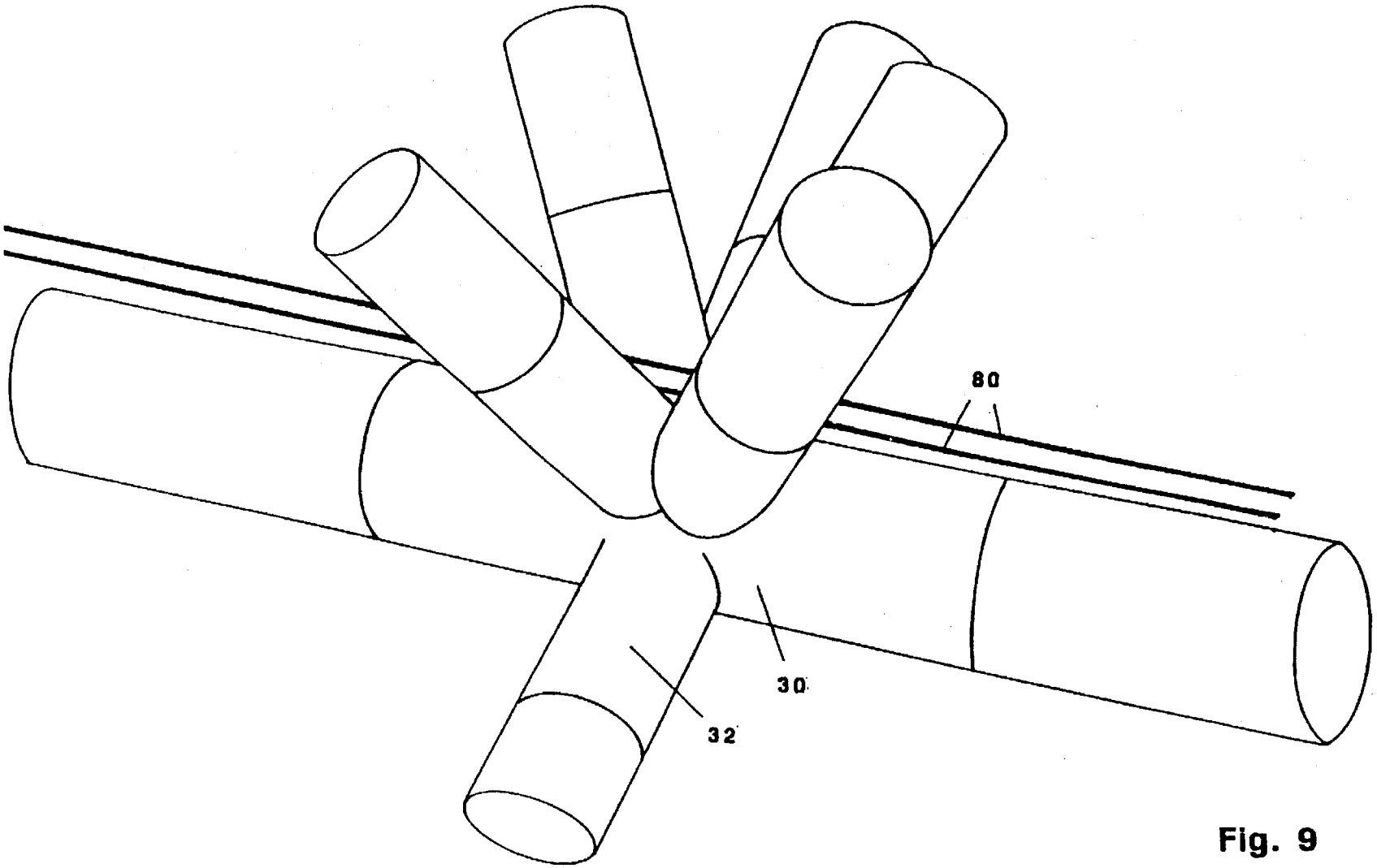
FIG. 9 is a perspective view of a node element of the space frame of FIG. 8.

FIGS. 7, 8 and 9 show the second embodiment which is identical to the first except that pre-stressing cables 80 have been added and, as a result, it has been possible to reduce the thickness and/or quality of the elongate tubular members 28. FIG. 8 shows one cable 80 which extends initially parallel to an upper longitudinal beam 18 and is diverted to extend downwardly at an angle. The cable 80 runs over a guide part (not shown) which is integral with a node element 30 to change direction. The cable 80 extends in the plane of one set of struts 26 across one lower node element 30 to the next lower node element 30, where it is guided by a further guide part integral with that node element 30 to change direction to extend parallel to a lower longitudinal beam 20. The cables 80 are provided adjacent each planar set of struts 26, as shown in FIG. 7.

The cables 80 also prevent the sections 34 of the concrete platform 14 cracking in areas of hogging flexure by exerting compressive pre-stress. As the cables 80 are alongside the pipes they can readily be inspected or replaced. In another embodiment however the cables 80 can be provided inside the tubular elongate members 28.

I claim:

1. A bridge suitable for long spans comprising a metal tubular space frame enclosed in a housing shell, having an upper surface and a lower surface, such that the housing shell protects the space frame from corrosion, the upper surface of the housing shell forming a vehicular platform and the lower surface of the housing shell being of a curved aerodynamic shape, forming a load bearing access and maintenance platform, and being made principally from fibre reinforced plastics material which is maintenance free.

2. A bridge as claimed in claim 1, in which the space frame includes pro-stressing cables within the housing shell.

3. A bridge as claimed in claim 2, in which the cables run alongside elongate members of the space frame run inside elongate members of the space frame.

4. A bridge as claimed in claim 1, in which the space frame is constructed so as include metal node elements and elongate space frame members.

5. A bridge as claimed in claim 4, in which each node element includes a plurality of sockets to receive the elongate tubular members.

6. A bridge as claimed in claim 4, in which the node elements and the elongate space frame members are welded together.

7. A bridge as claimed in claim 4 in which the space frame includes pre-stressing cables and guide parts are provided which are integral with the node elements, the pre-stressing cables running alongside or inside the elongate space frame members and over the guide parts.

8. A bridge as claimed in claim 4, wherein the node elements are cast.

9. A bridge as claimed in claim 1, in which at least part of the housing shell is made from a plurality of panels side by side interlinked by head-and-neck connections.

10. A bridge as claimed in claim 1, in which the space frame comprises an upper lattice and a lower lattice interlinked by struts.

* * * * *